US011060671B2

(12) United States Patent
Haberkorn et al.

(10) Patent No.: US 11,060,671 B2
(45) Date of Patent: Jul. 13, 2021

(54) LIGHTING DEVICE WITH IMPROVED CONNECTION TO THE POWER SUPPLY

(71) Applicant: LEDVANCE GmbH, Garching bei Munchen (DE)

(72) Inventors: Lene Haberkorn, Konigsbronn (DE); Klaus Eckert, Herbrechtingen (DE); Lambert Frye, Steinheim (DE)

(73) Assignee: LEDVANCE GMBH, Garching Bei Munchen (DE)

( * ) Notice: Subject to any disclaimer, the term of this patent is extended or adjusted under 35 U.S.C. 154(b) by 0 days.

(21) Appl. No.: 15/705,675

(22) Filed: Sep. 15, 2017

(65) Prior Publication Data

US 2018/0080611 A1 Mar. 22, 2018

(30) Foreign Application Priority Data

Sep. 16, 2016 (DE) ..... 102016117450.5

(51) Int. Cl.

| | |
|---|---|
| ***F21V 3/00*** | (2015.01) |
| ***F21V 5/00*** | (2018.01) |
| ***F21K 9/232*** | (2016.01) |
| ***F21K 9/90*** | (2016.01) |
| ***F21K 9/238*** | (2016.01) |
| *F21Y 107/00* | (2016.01) |
| *F21V 3/06* | (2018.01) |
| *F21Y 105/16* | (2016.01) |

(Continued)

(52) U.S. Cl.

CPC ..... *F21K 9/232* (2016.08); *F21K 9/238* (2016.08); *F21K 9/90* (2013.01); *F21V 3/061* (2018.02); *F21V 23/06* (2013.01); *F21V 29/85* (2015.01); *F21Y 2105/16* (2016.08); *F21Y 2107/00* (2016.08); *F21Y 2115/10* (2016.08)

(58) Field of Classification Search

CPC ... H01K 1/22; H01K 1/34; H01K 1/46; F21V 19/003; F21V 31/04; F21V 3/061; F21V 29/85; F21V 23/06; F21V 29/70; F21V 17/101; F21V 19/0025; F21V 23/003; F21K 9/232; F21K 9/60; F21K 9/23; F21K 9/90; F21K 9/238; H01L 25/0753; H01L 33/52; F21Y 2107/00; F21Y 2105/16; F21Y 2115/10

See application file for complete search history.

(56) References Cited

U.S. PATENT DOCUMENTS

2009/0184618 A1* 7/2009 Hakata ..... H01L 25/0753 313/1
2010/0253205 A1* 10/2010 Stark ..... H01K 1/46 313/318.1

(Continued)

FOREIGN PATENT DOCUMENTS

| | | | |
|---|---|---|---|
| DE | 202014004861 | U1 | 8/2014 |
| DE | 102013223904 | A1 | 5/2015 |
| JP | S6074260 | A | 4/1985 |

*Primary Examiner* — Thien T Mai
(74) *Attorney, Agent, or Firm* — Hayes Soloway PC

(57) ABSTRACT

A lighting device includes a translucent bulb and a light engine arranged in said bulb. The bulb comprises a base with two connection wires for connecting the light engine. The light engine comprises two connection elements which are electrically and mechanically connected to the connection wires. The connection elements each comprise a gripping region for holding the light engine and a connecting region for connecting the light engine to the connection wires.

21 Claims, 6 Drawing Sheets

(51) Int. Cl.

| | |
|---|---|
| *F21V 29/85* | (2015.01) |
| *F21V 23/06* | (2006.01) |
| *F21Y 115/10* | (2016.01) |

(56) References Cited

U.S. PATENT DOCUMENTS

| | | | | |
|---|---|---|---|---|
| 2010/0253221 | A1 | 10/2010 | Chiang | |
| 2013/0271989 | A1* | 10/2013 | Hussell | F21V 29/65 362/249.02 |
| 2014/0312760 | A1 | 10/2014 | Augustine | |
| 2015/0085489 | A1* | 3/2015 | Anderson | F21K 9/232 362/249.06 |
| 2016/0363267 | A1* | 12/2016 | Jiang | F21V 29/70 |
| 2017/0038010 | A1* | 2/2017 | Rao | F21K 9/232 |

* cited by examiner

LIGHTING DEVICE WITH IMPROVED CONNECTION TO THE POWER SUPPLY

CROSS-REFERENCE TO RELATED APPLICATION AND PRIORITY

This patent application claims priority from German Patent Application No. 102016117450.5 filed on Sep. 16, 2016, which is herein incorporated by reference in its entirety.

TECHNICAL FIELD

The present invention relates to a lighting device having an improved connection between light engine and power supply.

PRIOR ART

In known lighting devices which comprise a light engine, i.e. a device for generating light using light-emitting diodes (LEDs) for example, inside a translucent or transparent bulb, the connection region of the light engine is matched in each case to the associated base which the light engine is initially mounted on by means of individual holding elements before it is fixedly connected to the connection wires of the base, for example by welding.

PRESENTATION OF THE INVENTION

Based on the known prior art, it is an object of the present invention to provide an improved connection between light engine and power supply. In particular, a certain level of standardization should be possible, that is to say the attachment of different light engines to a standard base.

The object is achieved by a lighting device having the features of the independent claim. Advantageous developments emerge from the dependent claims.

A lighting device according to the invention comprises a translucent (i.e. light-transmissive, in particular transparent) bulb and in addition a light engine arranged in the bulb. A base, i.e. a structure that extends into the interior of the bulb, which is used to hold the light engine, is arranged in the bulb, in particular on its connection side. Such a base usually consists substantially of an elongated element which is provided at one end with a plate-like base. The base comprises two connection wires for connecting the light engine, i.e. both for mechanical mounting and also for electrical connection to the power supply. The light engine itself comprises two connection elements which are electrically and mechanically connected to the connection wires of the base. This connection can be accomplished by welding (e.g. resistance welding, laser welding), soldering, crimping, wrapping, clamping or by other known joining methods.

The connection elements of the light engine each comprise a gripping region and a connecting region. The gripping region is used to hold the light engine on the base during assembly of said light engine (e.g. with a gripper). In the connecting region, the connection between the connection elements of the light engine and the connection wires of the base can then be accomplished as described above. In particular, this connection can only be accomplished point-by-point, i.e. it is not necessary for the connecting region to be connected (e.g. welded) to the connection wires over its entire extent.

The embodiment of the connection elements according to the invention facilitates standardization of the connection between light engine and base or connection wires. It is therefore easily possible to implement a system in which different light engines can be connected to a common design of a base. In particular, this also facilitates site-independent production of the light engines as light engine and base need not be adapted to each other as long as the standardized specifications are complied with. Automation of the production process is also facilitated by the design of the connection elements according to the invention.

In one embodiment, the two connection elements of the light engine are each designed to be planar and are arranged in a common plane. This facilitates, for example, both gripping of the connection elements with a gripper and also positioning the connection elements adjacent to the connection wires of the base in such a manner that the connection referred to above can be made.

In one embodiment of the lighting device, the connecting region of each connection element is angled relative to its gripping region. In particular, the angle between the gripping region and connecting region of a connection element can be between approximately 90° and approximately 135°, e.g. also 100°, 110°, 120° or 130°. In particular, only one of the connection elements can include an angle between the gripping region and connecting region which differs from 180°. In addition, the angle between gripping region and connecting region can differ in size for both connection elements.

An angle between the gripping region and connecting region of a connection element facilitates the alignment of light engine and base, particularly if the connection wires extend from the base in a straight line. Then it is not specifically necessary to hold light engine and base at very precisely determined positions in order to establish a connection between them (e.g. by welding) but rather a certain tolerance range is possible in which both connecting regions and connection wires overlap.

An angle between the gripping region and connecting region of a connection element also allows various light engines, each having different distances between the two connection elements, to be connected to one type of base since the different distance, particularly between the gripping regions of the connection elements, can be bridged by the connecting region extending at an angle to said gripping regions.

The invention also includes the design where the connection wires which extend from the base are angled as described above for the connection elements and the connection elements of the light engine are straight. This "reversal" can also be used in the embodiments illustrated below and is encompassed by the invention.

In one embodiment of the lighting device, the free ends of the connection areas of the two connection elements point away from each other (outwards). As a result, the distance between the gripping regions of the connection elements can be kept small which can be advantageous for the design of the light engine, particularly facilitating compact light engines. Alternatively, the free ends of the connecting regions of the two connection elements can point in the same direction.

In one embodiment of the lighting device, the connecting region of each connection element is U-shaped (this is also understood to mean semicircular). In particular, the closed, round side of the U (or semicircle) can point to the side, i.e. the U can be located on the side opposite the extension of the gripping region, that is to say rotated by 90°. In particular, only one of the connection elements can have a U-shaped connecting region. The connecting region of the other connection element can then be formed, for example, linearly or at an angle to the gripping region (as described above).

In the case of a U-shaped connecting region, advantageously two connection points (crossover points) can be implemented in each case between a connecting region and the associated connection wire as a result of which the light engine can be mounted more sturdily on the connection wires.

Alternatively to a U-shaped connecting region, two connection points can also be implemented with a different configuration of the connection region, for example with a V-shaped connecting region or a different zigzag design.

In one embodiment of the lighting device, the closed, round sides of the U-shaped connecting regions of the two connection elements point away from each other (outwards). As a result, the distance between the gripping regions of the connection elements (as described above in the angled configuration of the connection elements) can be kept small which can be advantageous for the design of the light engine, particularly facilitating compact light engines.

Alternatively, the closed, round sides of the U-shaped connecting regions of the two connection elements can point towards each other (inwards).

In one embodiment of the lighting device, the light engine comprises one or a plurality of LED filaments. An LED filament is understood in this case to be a rod-shaped LED component which normally has a narrow strip of a transparent carrier (e.g. a transparent ceramic, such as sapphire), light-emitting diodes attached thereto in a row and, where appropriate, a fluorescent layer on the light-emitting diodes. Normally one electrical contact is located at each of the two ends of this LED component. Due to the light also radiating through the transparent carrier, such LED filaments allow more even illumination to be achieved without additional optical elements, such as lenses, reflectors or the like. For example, LED filaments marketed under the name Soleriq L 38 by the OSRAM Opto Semiconductors company can be used as LED filaments.

As an alternative or in addition to LED filaments, the light engine can also comprise a planar substrate (preferably transparent, e.g. sapphire) with light-emitting diodes arranged thereon (provided where appropriate with a fluorescent substance to achieve the desired color temperature).

In one embodiment of the lighting device, the light engine comprises a holding structure to which the LED filaments are attached and which is used for supplying power to the LED filaments. Using the holding structure simultaneously for the power supply also avoids additional holders which would lead to undesirable shadow casting.

As the LED filaments are very lightweight (typically a few grams), the holding structure can be very thin and delicate even when using a plurality of LED filaments (e.g. 4, 5, 6, 7, 8) in a light engine, resulting in them casting minimal shadow. For example, the holding structure can consist of wire (e.g. with a diameter of approximately 0.8 mm).

In one embodiment of the lighting device, the holding structure comprises an upper holding element which is electrically connected to a first one of the connection elements. In addition, the holding structure comprises a lower holding element which is electrically connected to a second one of the connection elements. Each LED filament is connected with a first end, which, as described above, can have an electrical contact, to the upper holding element and with a second end, which also, as described above, can have an electrical contact, to the lower holding element. This connection can preferably accomplish both mechanical mounting of the LED filaments on the holding structure and also electrical connection of the two ends of an LED filament to the relevant connection elements via the holding structure.

The two holding elements are thus arranged substantially above or below the LED filaments as a result of which the shadow cast by the holding elements is minimized.

Each of the two holding elements, for example, can be substantially circular or polygonal. Both holding elements can in particular have different shapes. Moreover, both holding elements can be different in size even if they both have substantially the same geometric shape.

Different shapes and/or sizes of the holding elements allow the LED filaments to be positioned such that said LED filaments are not arranged spatially parallel to each other thus minimizing the shadow cast by the LED filaments among each other.

In one embodiment of the lighting device, at least one of the holding elements together with the corresponding connection element and the connection therebetween is formed from a (preferably one-piece) wire. An electrically conductive wire allows the holding structure to be used simultaneously for supplying power to the LED filaments. At the same time, by using a wire for the holding structure, the shadow it casts can be minimized. The wire can consist of metal, preferably steel, and has, for example, a diameter between approximately 0.6 mm and approximately 1 mm, preferably approximately 0.8 mm.

For example, a wire can be shaped such that it starts as an angled or U-shaped connecting region of a connection element and then merges into the gripping region of the connection element. The wire extends further over a connecting region and merges into the upper or lower holding element. In the connecting region, the wire can be straight or it can be angled once or a plurality of times (preferably by approximately 90°). As a holding element, the wire can be bent, for example, in a circle and if necessary can provide a connection substantially in the circular plane to a point inside or outside the circle at which point the wire merges into the connecting region.

In a further embodiment of the lighting device, the light engine further comprises a holder, which connects the two parts of the holding structure, namely the first (partial) structure consisting of the upper holding element, the first of the connection elements and the electrical connection therebetween, and the second (partial) structure consisting of the lower holding element, the second of the connection elements and the electrical connection therebetween in an electrically non-conductive manner such a holder serves to stabilize the holding structure and is then particularly advantageous if the holding structure is thin and delicate in design, if for example both partial structures are each made of a wire.

A holder which connects the two partial structures to each other can be made, for example, of an electrically non-conductive plastic. The holder can preferably be designed in such a way that, after the two partial structures have been produced, it is connected to the two partial structures at locations provided for this purpose. For example, the holder can have a front part and a rear part, each abutting the holding structure from one side, and which are connected to each other, for example, by a snap-in connection. Front part and rear part of the holder are preferably also joined to each other in the non-assembled state by a flexible joining portion which facilitates mounting of the holder on the holding structure.

In one embodiment of the lighting device, the LED filaments are electrically connected in parallel. This enables special designs for the construction of an electronic driver for controlling the LED filaments.

In a further embodiment of the lighting device, the bulb is designed to be gas-tight and is filled with a gas for heat dissipation of the heat generated by the light engine, in particular with a gas that has high thermal conductivity. The gas preferably contains helium and/or hydrogen. The gas can also be a gas mixture of various gases. Such a gas for heat dissipation allows the LED lighting strip to be operated inside a closed bulb without additional heat sinks.

In one embodiment of the lighting device, the bulb and the base are made of glass. The base can then be fused with the bulb. At the same time, the connection wires can be fused into the base. As a result, it is possible in particular to bring about gas-tightness of the bulb. The connection wires protrude out of the base both inside the bulb and also outside the bulb. Inside the bulb, the connection wires are used for mechanical mounting of the light engine and for its power supply, as described above. Outside the bulb, the connection wires can be used with an electronic driver for controlling the light engine and in particular the LED filaments.

In one embodiment, the lighting device further has a socket. The lighting device can be fastened with this socket in a light fitting matching said socket.

The lighting device preferably also comprises a driver for controlling the light engine. The driver can be arranged inside the socket and can be electrically connected to the connection wires guided out of the bulb.

The bulb can be mechanically connected to the socket by a cement or an adhesive. This enables the bulb and socket to be connected without additional components. The bulb can preferably be designed such that its end directed towards the socket can be inserted into a portion of said socket. This provides a sufficiently large adhesive surface for connecting the bulb and socket.

BRIEF DESCRIPTION OF THE FIGURES

Preferred further embodiments of the invention will be explained in greater detail using the following description of the figures. In this case the drawings show.

DETAILED DESCRIPTION OF PREFERRED EMBODIMENTS

Preferred embodiments will be described below based on the figures. In this case, identical, similar or equivalent elements are provided with the same reference numbers in the different figures and repeated description of these elements is partly omitted to avoid redundancies.

Figure 1:
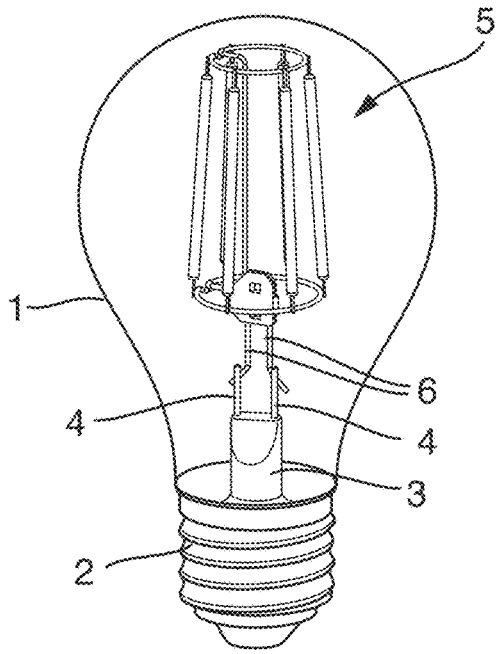
FIG. 1 an embodiment of a lighting device according to the invention.

FIG. 1 shows schematically an embodiment of an LED lighting device according to the invention. The lighting device comprises a transparent bulb 1 which is connected to a socket 2. The bulb 1 is preferably made of glass and is connected to the socket 2 by means of a cement or an adhesive. A base 3, also made of glass, into which two connection wires 4 are fused, is fused with the bulb 1.

A light engine 5 which is arranged inside the bulb 1 comprises two connection elements 6 which are mechanically and electrically conductively connected to the connection wires 4 in a connecting region, preferably they are welded at the crossover points of connection wires 4 and connection elements 6. The light engine 5 will be described in greater detail below with reference to FIG. 5.

Figure 2:
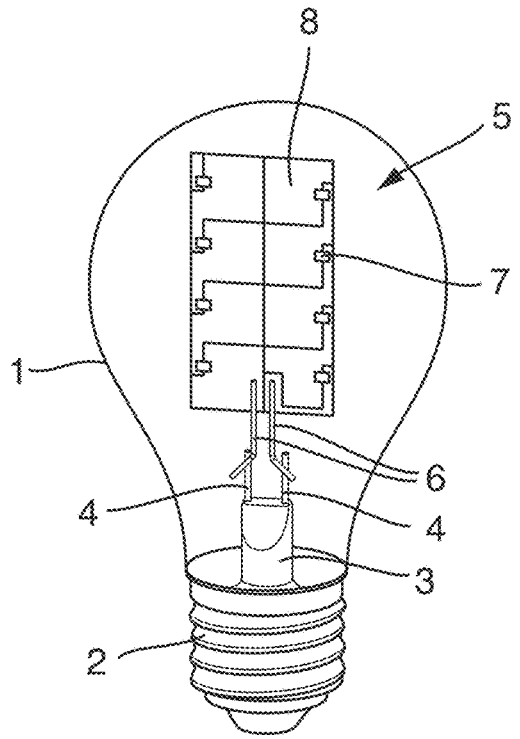
FIG. 2 a further embodiment of a lighting device according to the invention.

FIG. 2 shows schematically a further embodiment of an LED lighting device according to the invention. The lighting device according to FIG. 2 differs from the lighting device illustrated in FIG. 1 by the light engine 5 arranged inside the bulb.

The light engine 5 according to FIG. 2 comprises a flat substrate on one side of which eight light-emitting diodes 7 are arranged and which are electrically conductively connected to each other by conductive surfaces 8 on the substrate. The two connection elements 6 are also electrically conductively connected (e.g. by soldering, welding, etc.) to one each of the conductive surfaces 8. The substrate can, in particular, be transparent (e.g. made of sapphire glass) at the locations at which the light-emitting diodes 7 are attached such that the light emitted by the light-emitting diodes 7 can also be emitted through the substrate. The substrate, however, can also be non-transparent (e.g. a conventional circuit board). Then light-emitting diodes 7 are preferably arranged on both flat sides of the substrate to obtain the radiation of light in both directions.

Even if the following figures each show one of the aforementioned two light engines, the other light engine or even a light engine not described in greater detail herein can always be used.

Figure 3:
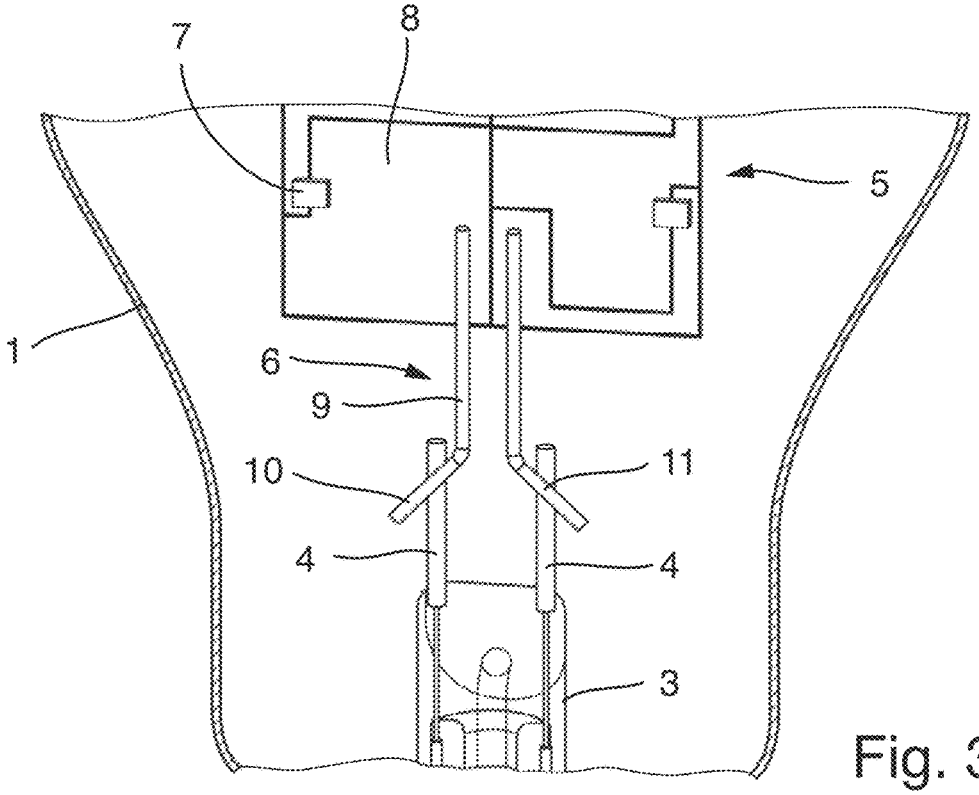
FIG. 3 an embodiment of connection elements according to the invention as a detail from FIG. 2.

FIG. 3 shows an enlarged detail from FIG. 2, from which the configuration of the connection elements 6 and their connection to the connection wires 4 can be seen. Each connection element 6 consists of a wire and comprises a gripping portion 9 and a connecting portion 10. The wire is bent by approximately 45° between the gripping portion 9 and the connecting portion 10 such that the angle between the gripping portion 9 and the connection portion 10 (with the apex at the point of the bend) is approximately 135°. The two connection elements 6 are connected to the substrate of the light engine 5 in such a manner that the free ends of the connecting portions 10 point away from each other, both connection elements 6 being arranged in the same plane. At the crossover points 11 of connection wires 4 and joining portions 10 of the connection elements 6, said connection elements 6 are mechanically and electrically conductively joined to the connection wires 4 by a welded joint.

It can also be seen from FIG. 3 how the connection wires 4 are fused into the base 3. As a result, the bulb 1 can be made gas-tight in order to hold therein a gas with high heat conductivity. It is not possible to see how the connection wires 4 emerge downwards from the base 3 and thus out of the bulb 1 (see FIG. 10).

Figure 4:
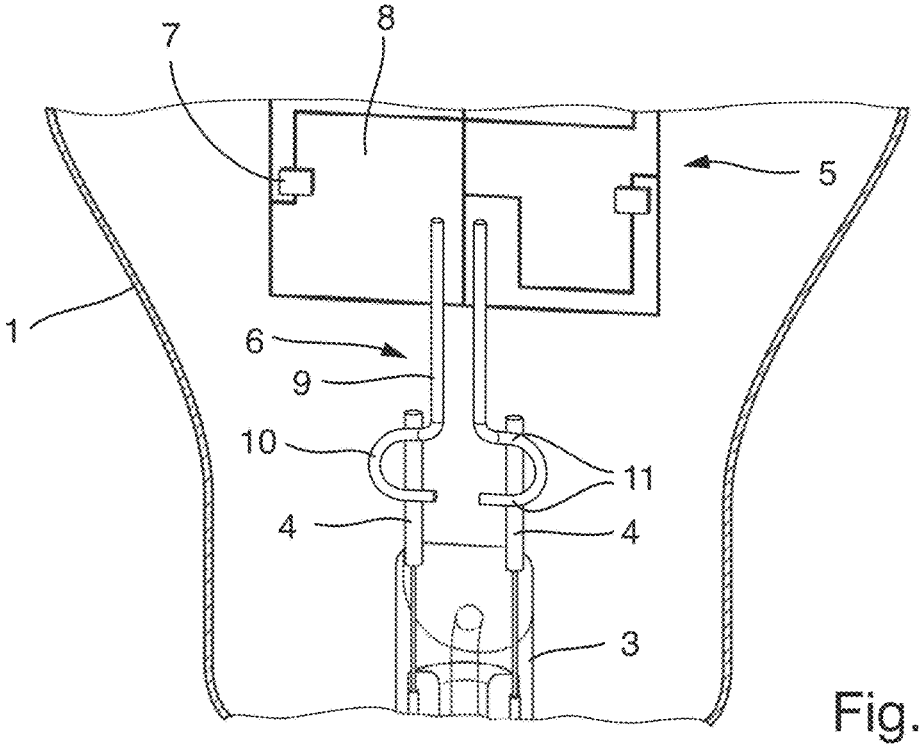
FIG. 4 a further embodiment of connection elements according to the invention.

The illustration in FIG. 4 corresponds to the illustration in FIG. 3, apart from the configuration of the connecting portion 10 of the connection elements 6. Each connection element 6 has a U-shape in the embodiment according to FIG. 4, the closed ends of the two U-shapes being arranged facing away from each other, outwards. Both connection elements 6 are arranged in a common plane as in FIG. 3.

The U-shaped configuration of the connecting portion 10 results in two crossover points 11 existing between each connecting portion 10 and the associated connection wire 4, at which points the connection elements 6 are mechanically and electrically conductively connected to the connection wires 4 by a welded joint. This leads in particular to a more sturdy mechanical connection of the light engine 5 to the base 3.

Figure 5:
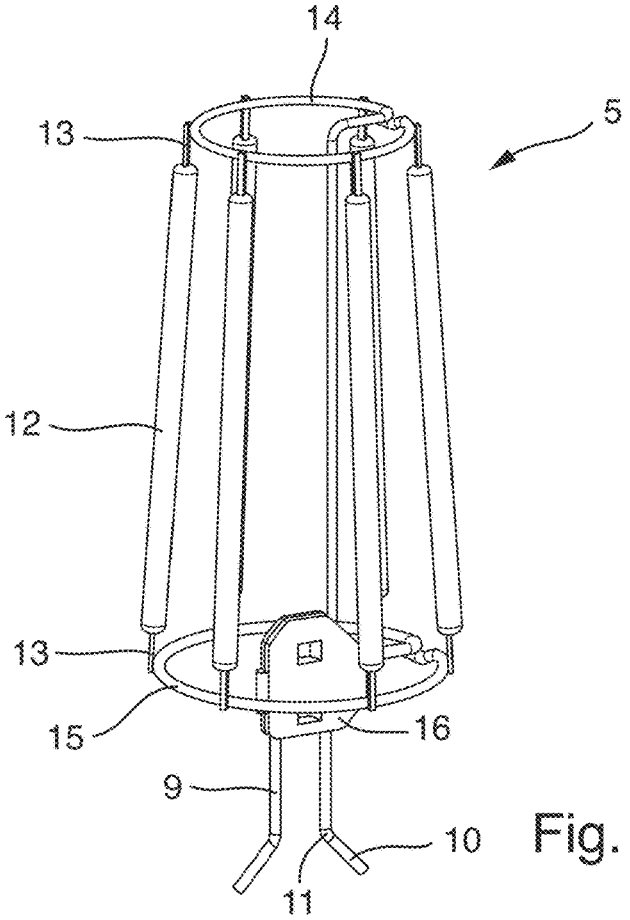
FIG. 5 an embodiment of a light engine according to the invention, comprising a holding structure with LED filaments attached thereto.

FIG. 5 shows schematically an embodiment of a light engine 5. The light engine 5 contains six LED filaments 12 which are attached with their electrical contacts 13 at both ends of a holding structure (e.g. by soldering, welding, etc.). The holding structure comprises two partial structures 14, 15 which are joined to each other by means of a holder 16. The two partial structures 14, 15 and the holder 16 are shown separately and explained in the following figures.

Both partial structures 14, 15 are each bent in one piece from a steel wire 0.8 mm thick.

Figure 6:
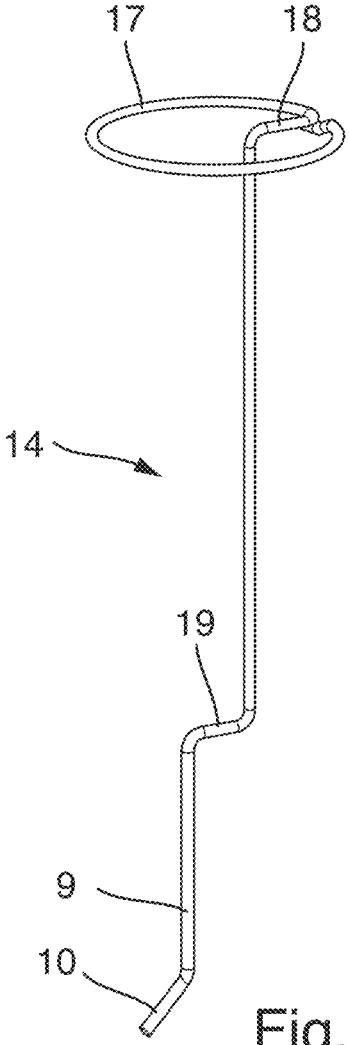
FIG. 6 a first partial structure of the holding structure from FIG. 5.

FIG. 6 shows the first partial structure 14 to which the LED filaments 12 are connected with their upper end. The upper portion of the wire, from which the partial structure 14 is made, is bent into a circle 17 which serves for the attachment of the LED filaments 12. The end of the wire has an S-shaped bend such that it extends along the beginning of the circular bend. The end of the wire can be electrically conductively connected to the beginning of the circular bend, e.g. by soldering welding, etc. From the beginning of the circular bend, the wire extends approximately radially (i.e. substantially in the plane of the circle) inwards a little bit and then bends downwards by approximately 90°.

The wire then runs straight down up to an S-shaped bend 19 (approximately 90° twice in opposing directions). After the S-shaped bend 19, the wire extends further downwards and merges into the gripping portion 9 of the connection element 6. After a further bend by approximately 45°, the wire ends as connecting portion 10 of the connection element 6.

Figure 7:
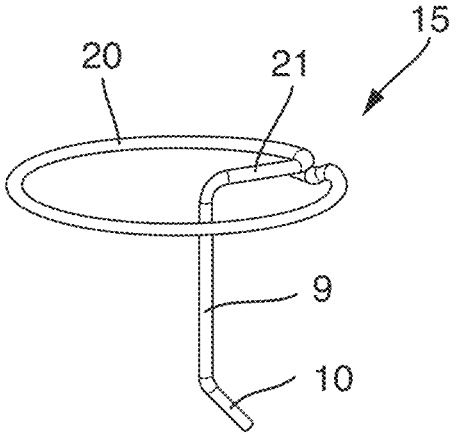
FIG. 7 a second partial structure of the holding structure from FIG. 5.

FIG. 7 shows the second partial structure 15 to which the LED filaments 12 are connected with their lower end. Like the first partial structure 14 according to FIG. 6, the upper portion of the wire is bent into a circle 20 and a radial portion 21. At the inner end of the radial portion 21, the wire bends downwards by approximately 90° and runs straight down where it merges into the gripping portion 9 of the connection element 6. After a further bend by approximately 45°, the wire ends as connecting portion 10 of the connection element 6.

The two circular portions 17, 20 of the partial structures 14, 15 have different diameters such that the LED filaments 12 are not parallel to each other when they are attached with their ends 13 to the circular portions 17, 20. This can be seen in FIG. 5.

Figure 8:
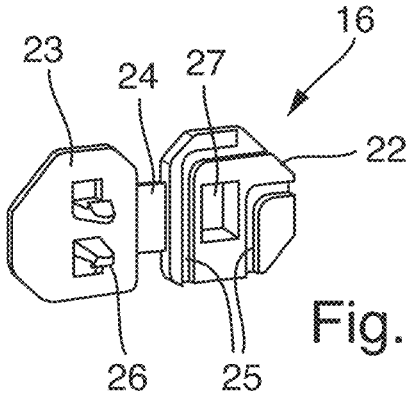
FIG. 8 a holder for connecting the partial structures of the holding structure from FIG. 5.

The holder 16, which connects the two partial structures 14, 15 to each other in an electrically non-conductive manner, is shown open in FIG. 8. The holder comprises a front part 23 and a rear part 22 which are movably connected to each other by means of a flexible bridge 24. Provided in the rear part 22 of the holder 16 are two channels 25, the depth of which substantially corresponds to the thickness of the wire of the two partial structures 14, 15. Both channels have an angle of approximately 90° such that the S-shaped bend 19 of the first partial structure 14 can be inserted into the one channel and the 90° bend on the inner end of the radial portion 21 of the second partial structure 15 can be inserted into the other channel. After inserting the two partial structures 14, 15 into the channels 25, the front part 23 of the holder 16 is folded over the rear part 22 and snaps with snap tabs 26 into a corresponding snap-in opening 27 in the rear part 22. As a result, the holder 16 is closed and fixes the two partial structures 14, 15 relative to each other.

Figure 9:
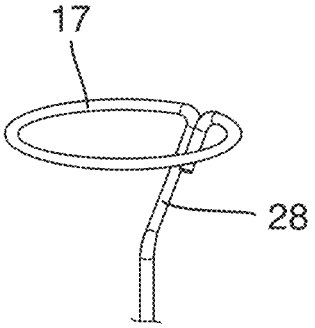
FIG. 9 a detail of a further embodiment of the two partial structures.

FIG. 9 shows schematically an alternative design of the circular portion 17 of the first partial structure 14. The circular portion 20 of the second partial structure 15 can also be configured in this alternative design. In the alternative design, instead of being guided radially inwards in the circular plane, the wire extends obliquely downwards and inwards with a portion 28. The wire end is not guided along the circle 17 but extends parallel to the portion 28 which extends obliquely downwards and inwards and can be electrically conductively connected thereto.

Figure 10:
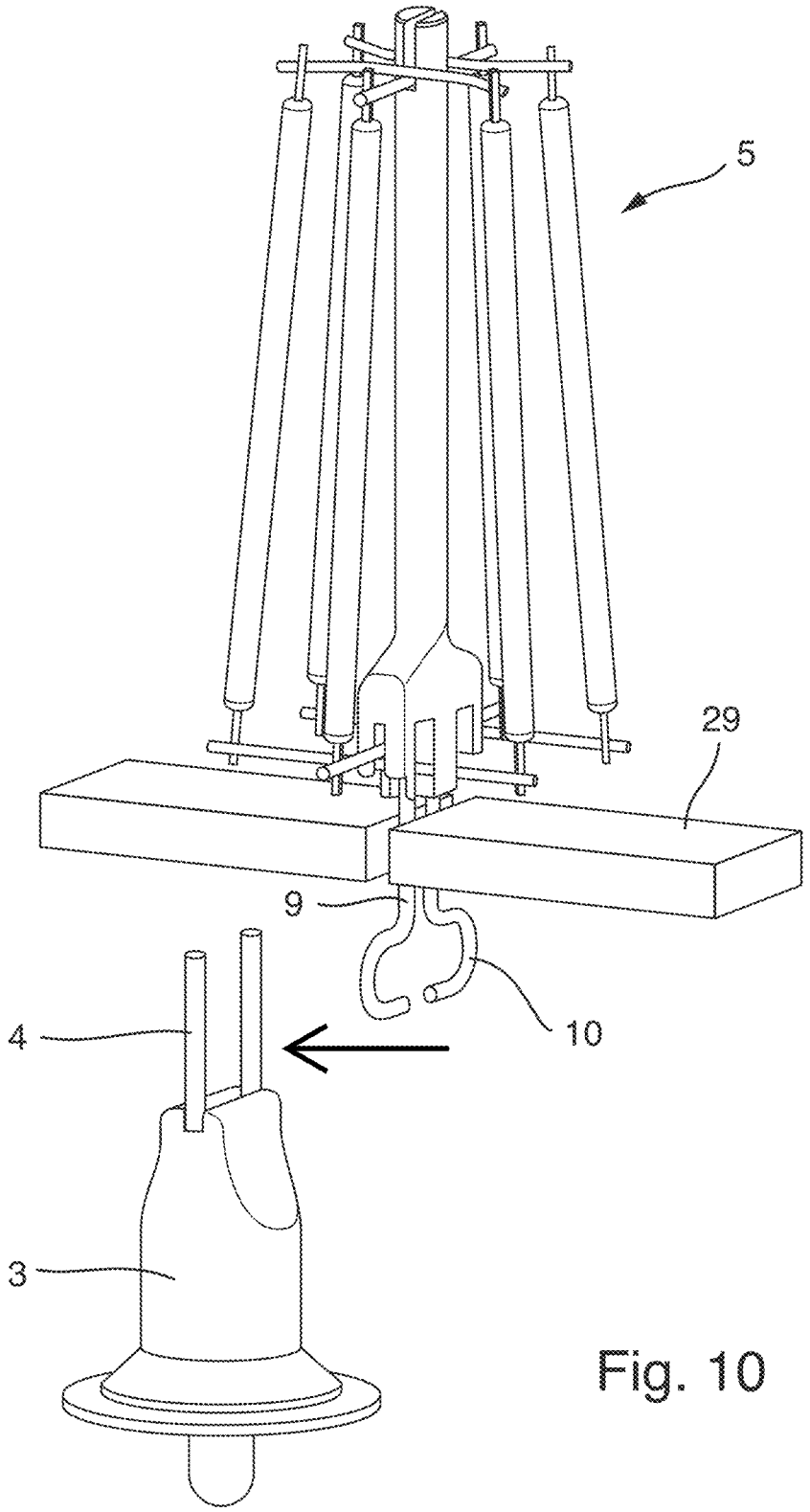
FIG. 10 the mounting of a light engine according to the invention with a gripper.

FIG. 10 shows how a light engine 5 is gripped by a schematically illustrated gripper 29 on the gripping portions 9 of the connection elements 6. Due to the arrangement of the gripping portions 9 in one plane, secure fixing is possible even with a simple gripper 29. The light engine 5 can then be moved by the gripper 29 (in the direction of the arrow) to the base 3 in such a manner that the connecting portions 10 are each arranged adjacent to a connection wire 4. Then the connecting portions 10 can be electrically conductively connected to the connection wires 4 by soldering, welding or the like. Even if a different configuration of the holder than that which was described above is to be seen in FIG. 10, the remarks regarding FIG. 10 nevertheless also apply to a light engine with a different holder, for example a holder as was described with reference to FIGS. 5-9.

Figure 11:
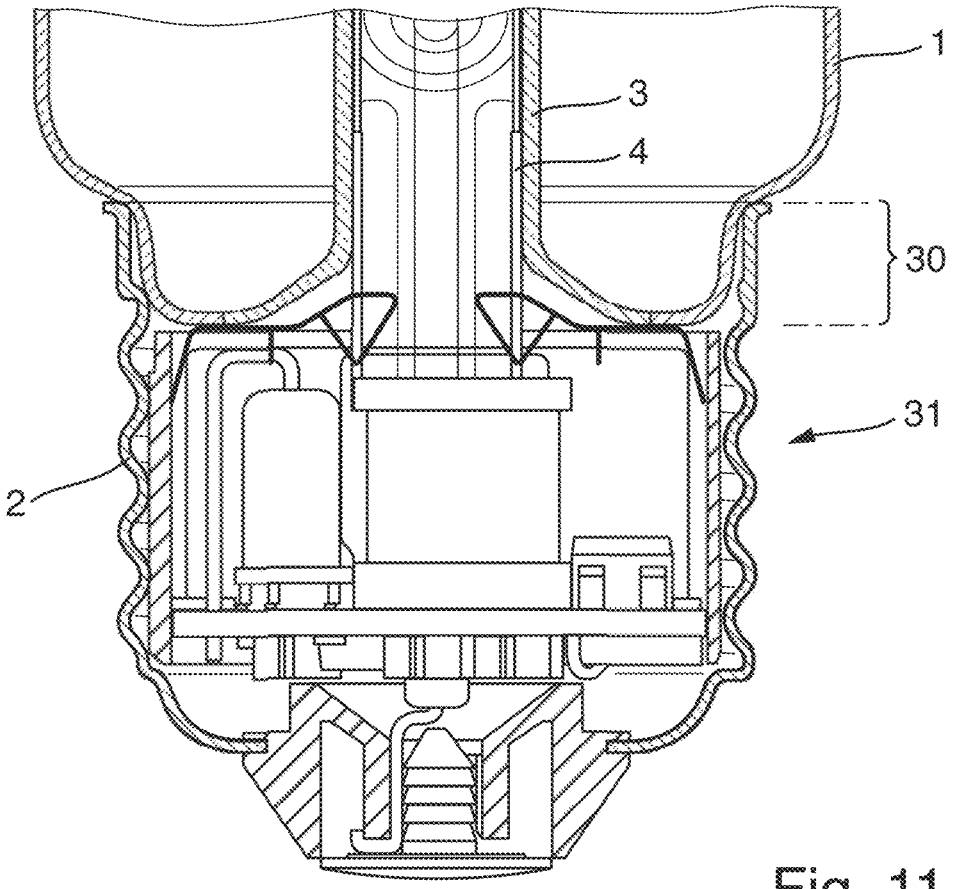
FIG. 11 a section through the socket of a lighting device according to the invention.

FIG. 11 shows schematically a cross-section through the socket 2 in an embodiment of the lighting device. The socket 2 provides the electrical connections to a light fitting (not shown). An electronic driver 31 which generates the electric voltage required for the light engine 5 from the electric voltage provided at the light fitting is arranged inside the socket 2. The driver 31 is electrically conductively connected to the connection wires 4 guided downward out of the base 3 and bulb 1.

The bulb 1 is inserted with its lower end into the socket 2 and is fixed in this overlap area 30 by means of a cement or an adhesive.

It can be seen from FIG. 11 that the bulb 1 is locked in the portion inserted into the socket 2 by fusing with the base 3 such that the bulb is designed overall as gas-tight.

The illustration in FIGS. 12*a*-12*d* corresponds to the illustration in FIGS. 3 and 4, apart from the configuration of the connecting portion 10 of the connection elements 6. In the embodiments illustrated here, both connection elements 6 are arranged, as in FIG. 3 and FIG. 4, in a common plane.

Figure 12A:
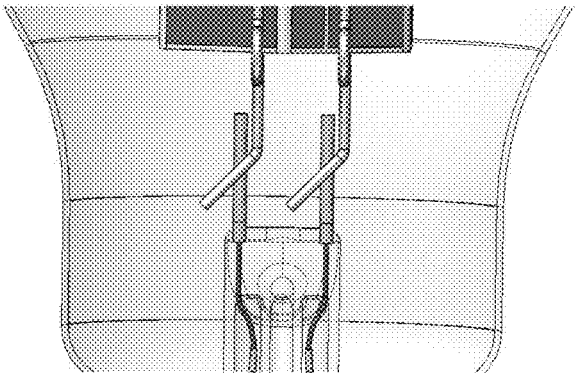
FIG. 12*a*-12*d* further embodiments of connection elements according to the invention.

In the embodiment according to FIG. 12*a*, the wire of the connection elements is bent by approximately 45° between the gripping portion 9 and the connecting portion 10 such that the angle between the gripping portion 9 and the connecting portion 10 (with the apex at the point of the bend) is approximately 135° (according to FIG. 3). The two connection elements 6 are connected to the substrate of the light engine 5 in such a manner that the free ends of the connecting portions 10 point in the same direction.

Figure 12B:
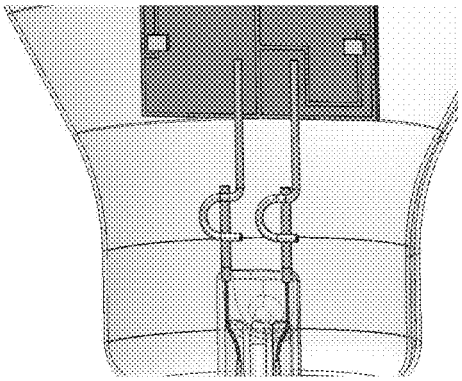

In the embodiment according to FIG. 12*b*, each connection element 6 has a U-shape (corresponding to FIG. 4), the closed ends of the two U-shapes pointing in the same direction.

Figure 12C:
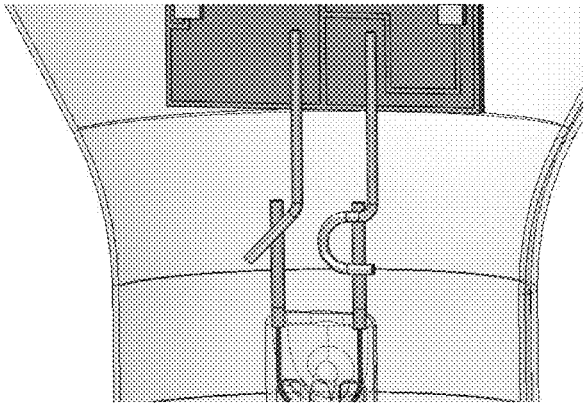

In the embodiment according to FIG. 12*c*, the wire of one of the connection elements is bent by approximately 45° between the gripping portion 9 and the connecting portion 10 such that the angle between the gripping portion 9 and the connecting portion 10 (with the apex at the point of the bend) is approximately 135° (according to FIG. 3). The other of the connection elements 6 has a U-shape (corresponding to FIG. 4).

Figure 12D:
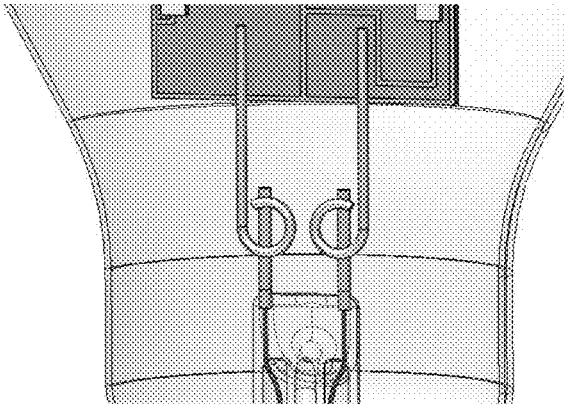

In the embodiment according to FIG. 12*d*, the wire of the two connection elements 6 is bent substantially circular, and preferably so far that the free ends are adjacent to the corresponding straight wire portions. As in FIG. 4, two crossover points 11 also exist here between each connecting portion 10 and the associated connection wire 4 which provides for a sturdy connection.

Although the invention has been illustrated and described in greater detail using the embodiments shown, the invention is not limited thereto and a person skilled in the art may derive other variations therefrom without departing from the scope of protection of the invention.

Generally, "one" may be understood to mean a single figure or a plurality, particularly in the sense of "at least one" or "one or more", etc., as long as this is not explicitly excluded, e.g. by the expression "exactly one".

A specified figure may also include exactly the number and also a customary tolerance range, as long as this is not explicitly excluded.

Where applicable, all the individual features illustrated in the embodiments can be combined and/or replaced with each other without departing from the scope of the invention.

LIST OF REFERENCE NUMBERS

1 Bulb
2 Socket
3 Base
4 Connection wire
5 Light engine
6 Connection element
7 Light-emitting diodes
8 Substrate
9 Gripping portion
10 Connecting portion
11 Crossover point between connection wire and connecting portion
12 LED filament
13 Electrical contact of the LED filament
14 First partial structure
15 Second partial structure
16 Holder
17 Circular portion of the first partial structure
18 Radial portion of the first partial structure
19 S-shaped bend in the first partial structure
20 Circular portion of the second partial structure
21 Radial portion of the second partial structure
22 Rear part of the holder
23 Front part of the holder
24 Flexible bridge
25 Channels
26 Snap tabs
27 Snap-fit opening
28 Inclined portion
29 Gripper
30 Overlap area between bulb and socket
31 Driver

The invention claimed is:

1. A lighting device comprising:
a translucent bulb; and
a light-emitting diode (LED)-based light engine arranged in said bulb;
wherein the bulb comprises a base with two connection wires configured for connecting the LED-based light engine;
wherein the LED-based light engine comprises two connection elements which are electrically and mechanically connected to the two connection wires, characterized in that the two connection elements each comprise:
a gripping region configured for engagement by a gripper to hold the LED-based light engine on the base during assembly of the lighting device; and
a connecting region which connects the connection element and the corresponding connection wire at one or more crossover points;
wherein for at least one of the two connection elements, the gripping region thereof and the connecting region thereof are offset relative to one another at an angle between about 90° and about 135°.

2. The lighting device according to claim 1, wherein the two connection elements are each designed to be planar and are arranged in a common plane.

3. The lighting device according to claim 1, wherein free ends of the connecting regions of the two connection elements either face away from each other or face in the same direction.

4. The lighting device according to claim 1, wherein:
the connecting region of each connection element is U-shaped; and
closed, round sides of the U-shaped connection elements either point away from each other or point towards each other.

5. The lighting device according to claim 1, wherein the LED-based light engine further comprises:
a plurality of LED filaments; and
a holding structure to which the plurality of LED filaments are attached and which is used for supplying power to the plurality of LED filaments.

6. The lighting device according to claim 5, wherein:
the holding structure comprises:
an upper holding element, which is electrically connected to a first one of the two connection elements; and
a lower holding element, which is electrically connected to a second one of the two connection elements; and
each of the plurality of LED filaments is connected with a first end to the upper holding element and with a second end to the lower holding element.

7. The lighting device according to claim 6, wherein at least one of the upper and lower holding elements together with a corresponding one of the connection elements and a connection therebetween is formed from a wire.

8. The lighting device according to claim 7, wherein the LED-based light engine further comprises a holder which connects:

a first structure consisting of the upper holding element, the first one of the two connection elements, and the electrical connection therebetween; and a second structure consisting of the lower holding element, the second one of the two connection elements, and the electrical connection therebetween in an electrically non-conductive manner.

9. The lighting device according to claim 5, wherein the plurality of LED filaments are electrically connected in parallel.

10. The lighting device according to claim 1, wherein the bulb is designed to be gas-tight and is filled with a gas for heat dissipation of the heat generated by the LED-based light engine, wherein the gas comprises at least one of helium and hydrogen.

11. The lighting device according to claim 1, wherein the bulb and the base are made of glass, and wherein the two connection wires are fused into the base.

12. The lighting device according to claim 1, wherein the lighting device further comprises:

a socket; and an electronic driver configured for controlling the LED-based light engine, wherein the electronic driver is arranged inside the socket and is electrically connected to the two connection wires guided out of the bulb.

13. A lighting device comprising:

a translucent bulb; and a light engine arranged in said bulb;

wherein the bulb comprises a base with two connection wires for connecting the light engine;

wherein the light engine comprises two connection elements which are electrically and mechanically connected to the connection wires, characterized in that the connection elements each comprise a gripping region and a connecting region;

wherein the light engine comprises a plurality of LED filaments and a holding structure to which the LED filaments are attached and which is used for supplying power to the LED filaments;

wherein the holding structure comprises an upper holding element, which is electrically connected to a first one of the connection elements, and a lower holding element, which is electrically connected to a second one of the connection elements, wherein each LED filament is connected with a first end to the upper holding element and with a second end to the lower holding element;

wherein at least one of the holding elements together with the corresponding connection element and the connection therebetween is formed from a wire; and wherein the light engine further comprises a holder which connects a first structure consisting of the upper holding element, the first one of the connection elements, and the electrical connection therebetween to a second structure consisting of the lower holding element, the second one of the connection elements, and the electrical connection therebetween in an electrically non-conductive manner.

14. The lighting device according to claim 1, wherein for each of the two connection elements, the connecting region thereof connects the connection element and the corresponding connection wire at least at two crossover points.

15. The lighting device according to claim 1, wherein:

for one of the two connection elements, the connecting region thereof connects said connection element and the corresponding connection wire at least at two crossover points; and for the other of the two connection elements, the connecting region thereof connects said connection element and the corresponding connection wire at only one crossover point.

16. The lighting device according to claim 1, wherein the LED-based light engine comprises a plurality of LEDs arranged over a planar, transparent substrate.

17. The lighting device according to claim 16, wherein the plurality of LEDs are electrically conductively connected to each other by one or more electrically conductive surfaces on the substrate.

18. The lighting device according to claim 17, wherein:

the one or more electrically conductive surfaces comprise at least two electrically conductive surfaces; and each of the two connection elements is electrically conductively connected to a corresponding one of the at least two electrically conductive surfaces.

19. The lighting device according to claim 16, wherein the lighting device further comprises:

a socket; and an electronic driver configured for controlling the LED-based light engine, wherein the electronic driver is arranged inside the socket and is electrically connected to the two connection wires guided out of the bulb.

20. The lighting device according to claim 1, wherein the gripping region transitions directly to the connecting region.

21. A lighting device comprising:

a translucent bulb; and a light-emitting diode (LED)-based light engine arranged in said bulb;

wherein the bulb comprises a base with two connection wires configured for connecting the LED-based light engine;

wherein the LED-based light engine comprises two connection elements which are electrically and mechanically connected to the two connection wires, characterized in that the two connection elements each comprise:

a gripping region configured for engagement by a gripper to hold the LED-based light engine on the base during assembly of the lighting device; and a connecting region which connects the connection element and the corresponding connection wire at one or more crossover points;

wherein the LED-based light engine further comprises:

a plurality of LED filaments; and a holding structure to which the plurality of LED filaments are attached and which is used for supplying power to the plurality of LED filaments;

wherein:

the holding structure comprises:

an upper holding element, which is electrically connected to a first one of the two connection elements; and a lower holding element, which is electrically connected to a second one of the two connection elements; and each of the plurality of LED filaments is connected with a first end to the upper holding element and with a second end to the lower holding element;

wherein at least one of the upper and lower holding elements together with a corresponding one of the connection elements and a connection therebetween is formed from a wire; and wherein the LED-based light engine further comprises a holder which connects:

a first structure consisting of the upper holding element, the first one of the two connection elements, and the electrical connection therebetween; and a second structure consisting of the lower holding element, the second one of the two connection elements, and the electrical connection therebetween in an electrically non-conductive manner.

* * * * *